United States Patent [19]

Schladitz

[11] 4,015,659

[45] Apr. 5, 1977

[54] HEAT PIPE

[76] Inventor: Hermann J. Schladitz, 74 Plaentschweg, Munich, Germany

[22] Filed: June 9, 1975

[21] Appl. No.: 584,951

[30] Foreign Application Priority Data

June 10, 1974 Germany ..... 2427968

[52] U.S. Cl. ..... 165/105; 29/157.3 R

[51] Int. Cl.[2] ..... F28D 15/00

[58] Field of Search ..... 165/105; 29/157.3 R

[56] References Cited

UNITED STATES PATENTS 3,706,127 12/1972 Oktay et al. ..... 165/133 X

OTHER PUBLICATIONS

Ingram et al., CG, Dendritic Wick for Heat Pipe, IBM Technical Disclosure Bulletin, vol. 14, No. 9, Feb., 1972.

Carbone et al., S, Metallic Wick for Heat Pipe, IBM Technical Disclosure Bulletin, vol. 13, No. 9, Feb., 1971.

*Primary Examiner*—Albert W. Davis, Jr.

*Attorney, Agent, or Firm*—Kane, Dalsimer, Kane, Sullivan and Kurucz

[57] ABSTRACT

A heat pipe consists of a tightly sealed pipe-shaped body. This body contains an inner capillary system, is partially filled with a volatile medium, and has a heat absorbing end and a heat emitting end. The capillary system consisting of polycrystalline metal whiskers, at least in the region of the heat absorbing end and of the heat emitting end of the heat pipe. These whiskers have a metal connection to the wall of the heat pipe.

4 Claims, 3 Drawing Figures

HEAT PIPE

BACKGROUND OF THE INVENTION

It is essential for the efficiency of heat pipes of the type contemplated that the largest possible amount of condensed medium be fed back through the capillary system, from the heat emitting end of the heat pipe to its heat absorbing end. To achieve this purpose, the effective diameter of the capillaries should be as small as possible, and as many capillaries as possible should be present. To accommodate as many capillaries as possible, the capillary system should have the greatest possible pore volume. The material of which the capillary system consists must be readily wettable by the volatile medium, since this factor is decisive in forming the capillary fluid column. Furthermore, the capillary system should consist of a material with good heat conductivity. This is necessary in order to secure rapid transfer of the applied heat to the volatile medium at the heat absorbing end of the heat pipe, and rapid transfer of the medium's heat to the wall of the heat pipe at its heat emitting end. Finally, it would be desirable for the capillary system to be very temperature resistant, so that liquids with high boiling points can be used, such as, for example, liquid metals like cadmium, cesium, sodium, zinc, and the like. This is particularly important when such heat pipes are used at temperatures of the order of 2000° C.

Known capillary systems meet the above requirements only to a very inadequate extent. Capillaries in the form of lengthwise grooves along the inner wall of the heat pipe can in practice be made only with relatively large dimensions, so that the capillary force is correspondingly small. Capillary systems of sintered metal power have large mass and a correspondingly small pore volume, which lies below 50%.

SUMMARY OF THE INVENTION

The invention is based on the task of creating a heat pipe, whose capillary system meets the requirements, enumerated in the foregoing, to an extremely considerable extent.

Polycrystalline metal whiskers (German Patent DTPS 1,224,934, "Zeitschrift fuer Metallkunde," 1968, number 1, pages 18 through 22, "Fachberichte fuer Oberflaechentechnikt" 1970, number ⅞, pages 145 through 150) are distinguished by high rigidity. They can therefore be used in thicknesses of a few $\mu$m to below one $\mu$m, to form a capillary system. This capillary system has an extraordinarily large pore volume, about 90%, on the one hand, but very high mechanical rigidity on the other hand. The pore size can be adjusted practically arbitrarily within broad limits, by appropriate filling and pressing. The capillary system is formed by an infinite number of extraordinarily thin metal whiskers, and it thus acquires a very large interior surface. This results in rapid heat transfer, at the heat absorbing end as well as at the heat emitting end of the heat pipe.

The capillary system can contain whiskers arranged at random or directed along parallel paths. Under appropriate circumstances, it can also consist of a skeleton of polycrystalline metal whiskers. These have a metallic contact with one another at the places where they touch. The metallic contact is established, for example, by depositing metal from the gas phase or by a sintering process.

Between the end sections, which consist of polycrystalline metal whiskers, the capillary system can also consist of metallized inorganic threads or fibers, for example, quartz fibers, glass fibers, and ceramic fibers with high melting points. This is possible because the heat conductivity of the capillary system is of only subordinate significance in this intermediate region.

The polycrystalline metal whiskers or the metallized inorganic threads preferably have an outer layer consisting of a metal that is preferentially wetted by the volatile medium. The outer layer can, for example, consist of nickel, chromium, tungsten, copper, silver, zinc, tin, cadmium, aluminum, titanium, cobalt, or molybdenum. The polychrystalline metal whiskers can also consist of alloys, as described in DT-PS 1,224,934. Because of the possibility of varying the chemical composition of the whiskers, a large number of different volatile media can be used.

The metallic connection of the capillary system with the wall of the heat pipe can be made in a fashion that is in itself known, by depositing metals through the thermal decomposition of a metal compound. Depositing metal from the gas phase is here especially preferred. This can be done, for example, by thermal decomposition of a metal carbonyl.

BRIEF DESCRIPTION OF THE DRAWINGS

An embodiment of the invention is described below, with reference to the drawing in which.

DETAILED DESCRIPTION

Figure 1:
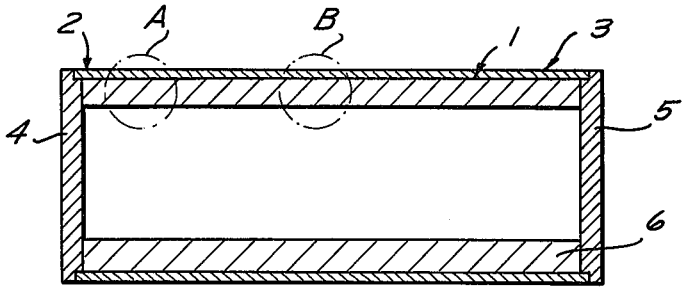
FIG. 1 shows a heat pipe according to the invention, in longitudinal section.

The heat pipe shown in FIG. 1 consists of a pipe-shaped body 1, which is made of a material with good heat conductivity. It is closed at its two ends 2 and 3 by covers 4 and 5. The interior wall of pipe 1 is connected with a capillary system, which has the form of a hollow cylinder. The capillary system is in general designated by 6. A volatile medium is present in capillary system 6. This medium is volatilized by applying heat to the heat absorbing end 2 of the heat pipe. The vapor which occupies more space than the liquid flows along pipe 1 to the other heat emitting end 3 of the heat pipe 1. There it condenses. Condensation generates an underpressure which conveys more vapor from the heat absorbing end 2 to the heat emitting end 3. Because of the capillary action of capillary system 6, the condensed medium flows back to the heat absorbing end 2 of the heat pipe.

Figure 2:
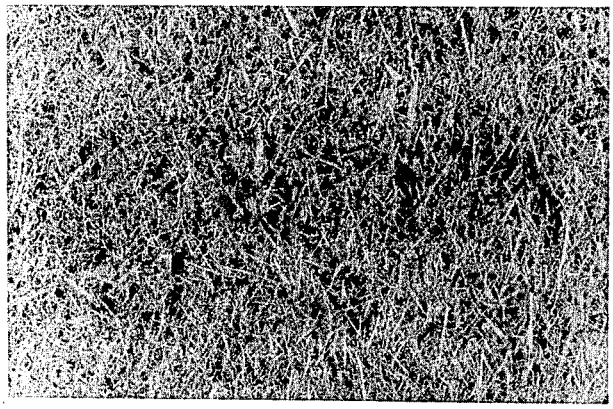
FIG. 2 shows a microphotograph of the capillary system in the region A of FIG. 1.
Figure 3:
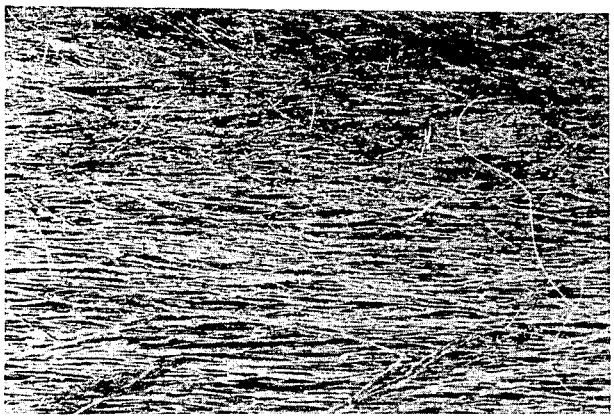
FIG. 3 shows a microphotograph of the capillary system in the region B of FIG. 1.

In the embodiment shown, the capillary system 6 consists of polycrystalline metal whiskers. These have a metallic connection to the interior wall of the heat pipe, at least in the region of its ends 2 and 3. In the region of ends 2 and 3, the capillary system is formed by a felt of polycrystalline metal whiskers in random directions. A microphotograph of this felt, enlarged 20 times, is shown in FIG. 2. This felt has a pore volume of about 90% with a whisker diameter of about 3 to 5$\mu$m. Between ends 2 and 3, the capillary system is formed by polycrystalline metal whiskers aligned parallel to one another. FIG. 3 again shows these whiskers enlarged 20 times. The capillaries between the whiskers have a diameter less than 10 $\mu$m.

The whiskers can be connected to one another to form a self-supporting skeleton. This can be done by hot pressing, sintering, and other procedures usual in powder metallurgy, as well as by depositing metals, e.g., from the gas phase. The same procedures effect the metallic connection of the capillary system 6 to the pipe wall, at least in the region of the heat absorbing end 2 and of the heat emitting end 3 of pipe 1.

The invention is not limited to the embodiment shown, but can be used equally successfully with so-called heat plates. These work according to the same principle as heat pipes, and are practically distinguished from them only by a different cross-sectional shape.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

What is claimed is:

1. A heat pipe, comprising a tightly sealed pipe-shaped body having an inner capillary system, said body being partially filled with a volatile medium and having a heat absorbing end and a heat emitting end, the capillary system comprised of polycrystalline metal whiskers at least in the region of the heat absorbing end and of the heat emitting end of the heat pipe, the whiskers having a metallic connection to the wall of the heat pipe the capillary system including metallized inorganic threads or fibers, between the end sections of polycrystalline metal whiskers.

2. A heat pipe according to claim 1, wherein the metallized inorganic threads has an outer metallic layer, the metal of this layer being preferentially wetted by the volatile medium.

3. A heat pipe according to claim 2, wherein the outer layer is selected from the group consisting of one of the metals, nickel, copper, silver, zinc, tin, cadmium, aluminum, chromium, tungsten, cobalt, titanium, molybdenum, or alloys of these metals.

4. A heat pipe, comprising a tightly sealed pipe-shaped body having an inner capillary system, said body being partially filled with a volatile medium and having a heat absorbing end and a heat emitting end, the capillary system comprised of polycrystalline metal whiskers at least in the region of the heat absorbing end and of the heat emitting end of the heat pipe, the whiskers having a metallic connection to the wall of the heat pipe, the capillary system having the composition, in the region of the heat absorbing and the heat emitting end of the heat pipe of a felt of unaligned metal whiskers, and between these ends of metal whiskers or metallized inorganic threads aligned parallel to one another and to the lengthwise direction of the heat pipe.

* * * * *